US008847727B2

(12) United States Patent
Shapiro et al.

(10) Patent No.: US 8,847,727 B2
(45) Date of Patent: Sep. 30, 2014

(54) ELECTRONICALLY-CONTROLLED WATER DISPENSING SYSTEM

(75) Inventors: David Alan Shapiro, Huntington Beach, CA (US); Pavitra Raj Pandey, Rancho Cucamonga, CA (US)

(73) Assignee: David Alan Shapiro, Huntington Beach, CA (US)

( * ) Notice: Subject to any disclaimer, the term of this patent is extended or adjusted under 35 U.S.C. 154(b) by 190 days.

(21) Appl. No.: 12/964,576

(22) Filed: Dec. 9, 2010

(65) Prior Publication Data

US 2011/0260827 A1 Oct. 27, 2011

Related U.S. Application Data

(60) Provisional application No. 61/327,799, filed on Apr. 26, 2010.

(51) Int. Cl.
*G05B 23/02* (2006.01)
*E03C 1/05* (2006.01)
*E03B 1/04* (2006.01)

(52) U.S. Cl.
CPC .. *E03C 1/057* (2013.01); *E03B 1/04* (2013.01)
USPC ..... 340/3.1; 340/572.1; 340/539.13; 340/521

(58) Field of Classification Search
USPC ..... 340/10.1, 573.1, 3.1, 572.1, 539.13, 340/521
See application file for complete search history.

(56) References Cited

U.S. PATENT DOCUMENTS 4,867,189 A * 9/1989 Moineau ..... 137/1
4,921,209 A 5/1990 Moineau
4,936,508 A 6/1990 Ingalz
4,944,049 A * 7/1990 Leonard ..... 4/597
5,402,812 A 4/1995 Moineau et al.
5,979,776 A * 11/1999 Williams ..... 236/12.12
6,016,836 A 1/2000 Brunkhardt
6,129,103 A 10/2000 Fields et al.
6,426,701 B1 * 7/2002 Levy et al. ..... 340/573.1
6,457,696 B1 10/2002 Hirota
6,636,151 B2 * 10/2003 Busick ..... 340/521
6,695,281 B2 2/2004 Williams, Jr.
6,892,952 B2 * 5/2005 Chang et al. ..... 236/12.12
6,899,133 B2 5/2005 Brunkhardt
6,925,661 B1 * 8/2005 Anger ..... 4/559
6,997,064 B2 * 2/2006 Bird et al. ..... 73/861.75
7,360,413 B2 * 4/2008 Jeffries et al. ..... 73/195
7,376,839 B2 5/2008 Carta et al.
7,605,704 B2 * 10/2009 Munro et al. ..... 340/572.1
7,761,937 B2 * 7/2010 Foutz et al. ..... 4/597
7,804,409 B2 * 9/2010 Munro et al. ..... 340/572.1
7,818,083 B2 * 10/2010 Glenn et al. ..... 700/108
7,857,234 B2 * 12/2010 Daley et al. ..... 236/12.12

(Continued)

OTHER PUBLICATIONS

Shower Manager—Shower Timer; printed from www.shower manager.com; Apr. 7, 2010 (3 pages).

(Continued)

*Primary Examiner* — Jennifer Mehmood
*Assistant Examiner* — Rufus Point
(74) *Attorney, Agent, or Firm* — Convergent Law Group LLP

(57) ABSTRACT

The present invention provides an electronic shower system or other water dispensing system used for personal hygiene that incorporates both electronic access control technology and electronic water flow control means and, optionally, stored value monitoring technology.

10 Claims, 8 Drawing Sheets

(56) References Cited

U.S. PATENT DOCUMENTS

| | | | | |
|---|---|---|---|---|
| 7,970,715 | B2 * | 6/2011 | Al-Harbi | 705/412 |
| 8,132,778 | B2 * | 3/2012 | Connors | 251/129.04 |
| 8,145,359 | B2 * | 3/2012 | Addink | 700/284 |
| 8,169,327 | B2 * | 5/2012 | Lynn | 340/573.1 |
| 8,176,948 | B2 * | 5/2012 | Carrig | 141/21 |
| 8,264,322 | B2 * | 9/2012 | Rodenbeck et al. | 340/5.64 |
| 8,554,496 | B2 * | 10/2013 | Donnelly et al. | 702/45 |
| 2002/0042660 | A1 * | 4/2002 | Atkinson | 700/65 |
| 2002/0101346 | A1 * | 8/2002 | Busick | 340/521 |
| 2003/0093161 | A1 | 5/2003 | Gauthier et al. | |
| 2003/0233885 | A1 | 12/2003 | Bird et al. | |
| 2004/0254746 | A1 | 12/2004 | Marcichow | |
| 2005/0016603 | A1 | 1/2005 | Brunkhardt | |
| 2005/0210576 | A1 | 9/2005 | Guerin et al. | |
| 2007/0182571 | A1 * | 8/2007 | Kennish et al. | 340/573.1 |
| 2008/0078710 | A1 * | 4/2008 | Larkner | 210/109 |
| 2008/0103636 | A1 * | 5/2008 | Glenn et al. | 700/302 |
| 2008/0136649 | A1 * | 6/2008 | Van De Hey | 340/573.1 |
| 2009/0025807 | A1 * | 1/2009 | August et al. | 137/624.11 |
| 2009/0100593 | A1 * | 4/2009 | Lincoln et al. | 4/623 |
| 2009/0106891 | A1 * | 4/2009 | Klicpera | 4/605 |
| 2009/0230200 | A1 | 9/2009 | Kempf et al. | |
| 2009/0237254 | A1 * | 9/2009 | Munro et al. | 340/572.1 |
| 2009/0242074 | A1 * | 10/2009 | Carrig | 141/26 |
| 2009/0255049 | A1 * | 10/2009 | Rosenau | 4/584 |
| 2009/0261282 | A1 * | 10/2009 | Connors | 251/129.01 |
| 2009/0293189 | A1 * | 12/2009 | Somerville | 4/597 |
| 2009/0293190 | A1 | 12/2009 | Ringelstetter et al. | |
| 2009/0307116 | A1 * | 12/2009 | Al-Harbi | 705/34 |
| 2010/0148971 | A1 * | 6/2010 | Wawrla et al. | 340/573.1 |
| 2010/0200789 | A1 * | 8/2010 | Connors | 251/129.04 |
| 2010/0328076 | A1 * | 12/2010 | Kyle et al. | 340/573.1 |
| 2011/0018718 | A1 * | 1/2011 | Kennish et al. | 340/573.1 |
| 2011/0057799 | A1 * | 3/2011 | Taneff | 340/573.1 |
| 2011/0068192 | A1 * | 3/2011 | Klicpera | 239/74 |
| 2011/0316703 | A1 * | 12/2011 | Butler et al. | 340/573.1 |
| 2012/0004778 | A1 * | 1/2012 | Lai et al. | 700/282 |
| 2012/0026004 | A1 * | 2/2012 | Broniak et al. | 340/870.02 |
| 2012/0112906 | A1 * | 5/2012 | Borke et al. | 340/539.13 |
| 2012/0234409 | A1 * | 9/2012 | Klicpera | 137/551 |

OTHER PUBLICATIONS

Shower Timer/Aquaflow Distributors, printed from www.showertimer.com; Apr. 7, 2010 (2 pages).

* cited by examiner

ELECTRONICALLY-CONTROLLED WATER DISPENSING SYSTEM

This application claims priority to U.S. Ser. No. 61/327,799 filed 26 Apr. 2010.

STATEMENT REGARDING FEDERALLY SPONSORED RESEARCH OR DEVELOPMENT

This invention was made without the support of the Federal Government.

FIELD OF THE INVENTION

The present invention relates to an electronically-controlled shower system or other personal water dispensing system that incorporates electronic access control technology and, optionally, monitors stored value.

BACKGROUND OF THE INVENTION

In the following discussion, certain personal water dispensing systems will be described for background and introductory purposes. Nothing contained herein is to be construed as an "admission" of prior art. Applicant expressly reserves the right to demonstrate, where appropriate, that the articles and methods referenced herein do not constitute prior art under the applicable statutory provisions.

The Earth has a finite supply of fresh water, stored in aquifers, surface waters and the atmosphere. Sometimes oceans are mistaken for available water, but the amount of energy needed to convert saline water to potable water is prohibitive today. Drought dramatizes the underlying tenuous balance of safe water supply; however, the entire human population is vulnerable to fresh water shortages. For example, according to the California Department of Water Resources, if more fresh water supplies are not found by 2020 the region will face a shortfall nearly as great as the amount consumed today. Also, water deficits, which are already spurring heavy grain imports in numerous smaller countries, may soon do the same in larger countries such as China and India. Moreover, water tables are falling in scores of countries (including Northern China, the US, and India) due to widespread overpumping using powerful diesel and electric pumps. Other countries affected include Pakistan, Iran, Australia and Mexico. Such overpumping will eventually lead to water scarcity and cutbacks in grain harvest. Most of the 3 billion people projected to be added worldwide by mid-century will be born in countries already experiencing water shortages.

The present invention provides a solution to monitoring water use for personal hygiene in situations where water rationing may be desired or necessary, adding a more flexible solution than merely restricting water flow. The problem of extended showers, for example, is the wasting of water and the energy used to process and heat the water. Prior art devices have made some strides in the direction of monitoring and rationing water for personal use, but there seems to be a lack of enthusiasm for many of these devices. What has not been available until now is a shower system or other water dispensing system used for personal hygiene that incorporates both electronic access control technology and value monitoring technology. The present invention meets this unmet need.

SUMMARY OF THE INVENTION

This Summary is provided to introduce a selection of concepts in a simplified form that are further described below in the Detailed Description. This Summary is not intended to identify key or essential features of the claimed subject matter, nor is it intended to be used to limit the scope of the claimed subject matter. Other features, details, utilities, and advantages of the claimed subject matter will be apparent from the Detailed Description herein including those aspects illustrated in the accompanying drawings and defined in the appended claims.

The present invention provides an electronic shower system or other water dispensing system used for personal hygiene that incorporates both electronic access control technology and electronic water flow control apparatus and, optionally, stored value monitoring technology.

Thus, in one embodiment, the present invention provides a water dispensing system for personal hygiene comprising one or more electronic access control devices; two or more electronically-controlled water delivery devices; at least one central control unit; and computer code, wherein the computer code verifies credentials, activates water flow to the two or more electronically-controlled water delivery devices, measures time and/or volume of the water flow, and records the measured time or volume of water flow for each credential. In some aspects of this embodiment, the electronic access control device comprises an access card and an electronic access card reader, and in preferred aspects, the access card is a stored value card. In yet other aspects of this embodiment, the electronic access card reader communicates wirelessly with said two or more electronically-controlled water delivery devices. In an alternative embodiment, the electronic access control device comprises a keypad and the credentials are a code keyed into the keypad by a user. In preferred embodiments, each of the electronically-controlled water delivery devices comprises a solenoid valve. In some aspects, the solenoid valves are controlled by computer code executed by the central control unit, yet in other aspects, the solenoid valves are controlled by computer code executed by the electronic access control device. In preferred embodiments, the computer code further comprises code to add and subtract stored value associated with a credential.

Other embodiments of the present invention provide a method for controlling a water dispensing system for personal hygiene, comprising: presenting credentials to an electronic access control device; determining whether permission to use the water dispensing system should be granted to said credentials; activating electronic water flow control apparatus coupled to the water dispensing system if permission is granted and not activating the electronic water flow control apparatus coupled to the water dispensing system if permission is not granted; activating a time or volume meter associated with the activated electronic water flow control apparatus; deactivating the time or volume meter when the electronic water flow control apparatus is deactivated; recording the time or volume; and associating the recorded time or volume with the credential. In preferred embodiments, the electronic water flow control apparatus is a valve, and in preferred embodiments, the valve is a solenoid valve. The electronic water flow control apparatus may be deactivated by a user directly turning the electronic water flow control apparatus off (e.g., by turning the faucet off) or the electronic water flow control apparatus may be deactivated by presenting credentials once again to the electronic access control system. Also in preferred embodiments, the method further comprises the step of deducting an amount of stored value associated with a credential wherein the amount of stored value deducted is proportional to the recorded time or volume.

DETAILED DESCRIPTION OF THE INVENTION

In the following description, numerous specific details are set forth to provide a more thorough understanding of the present invention. However, it will be apparent to one of skill in the art that the present invention may be practiced without one or more of these specific details. In other instances, well-known features and procedures well known to those skilled in the art have not been described in order to avoid obscuring the invention.

The present invention provides an electronic shower system or other water dispensing system used for personal hygiene that incorporates both electronic access control technology and electronic water flow control apparatus and, optionally, stored value monitoring technology. Such a water dispensing system allows measurement and control of water use for, e.g., dormitories, barracks, health clubs, boarding houses, prisons or other buildings providing facilities for personal hygiene. Advantages of the water dispensing or shower system include but are not limited to allowing allocation of cost to users proportional to the amount of use, heightening awareness of water consumption, providing information about water consumption in real time, and allowing a single water dispensing system to control two to many devices simultaneously.

The water dispensing system comprises one or more electronic access control devices; two or more electronically-controlled water delivery devices; at least one central control unit and software and/or firmware. The electronic access control device may be a keypad, or may comprise an electronic access card such as a "smart card" and an electronic access card reader. The electronically-controlled water delivery device comprises a faucet, shower and/or toilet and electronic water flow control apparatus coupled to the faucet, shower or toilet. The software and/or firmware (computer code) of the water dispensing system functions to detect credentials of users, permit or deny access to the system based on the user's credentials, activate and deactivate the electronically-controlled water delivery devices (most typically through control of solenoid valves), monitor use of the water delivery devices via, e.g., a timer or volume meter, and store user and time and/or volume information. Exemplary methods of use of the present invention will be discussed first, and then exemplary devices that may be used to implement the method will be discussed.

Figure 1A:
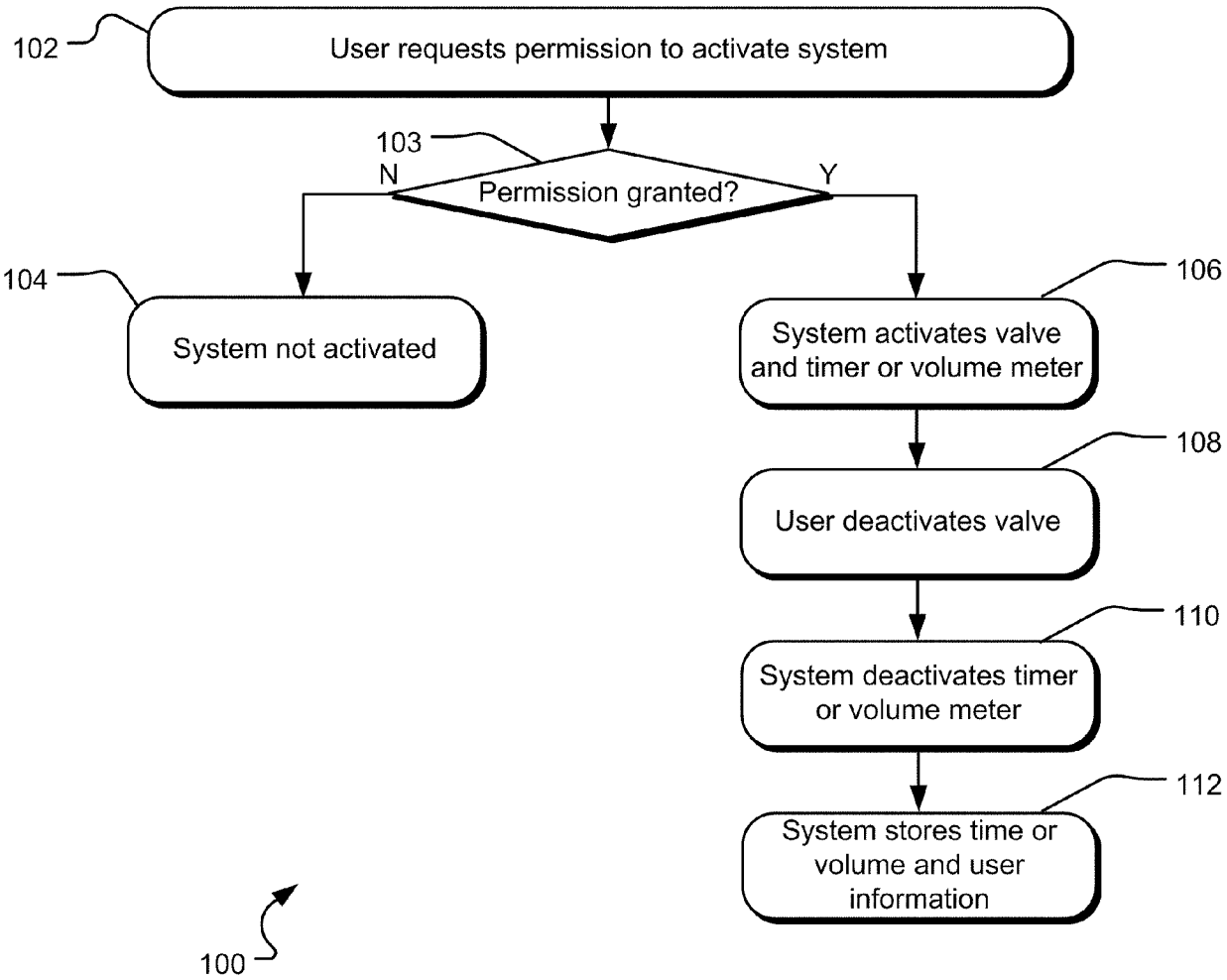
FIGS. 1A through 1D are flow diagrams tracking alternative methods of use for the shower system of the present invention.

FIG. 1A is a flow diagram tracking one exemplary method of use for the electronic water dispensing system according to the present invention. In method 100, a first step comprises a user requesting permission to activate the shower system 102 by, e.g., presenting credentials to an electronic access control device which can activate the water delivery device. The electronic access control device may be a keypad, an electronic access card and an electronic access card reader or any other electronic access control device known in the art. At decision point 103, the water dispensing system grants or denies access to the water delivery device. If permission is not granted, the system is not activated 104 and the user does not gain access to the water supply. However, if permission is granted, the water dispensing system activates both the electronic water flow control apparatus (typically a valve) of the water delivery device (a shower, for example) and a timer or volume meter 106. Once activated, the water dispensing system remains activated until the user deactivates the valve 108 by, e.g., turning off the faucet. At this point, the water dispensing system detects the deactivated electronic water flow control apparatus and in turn deactivates the timer or volume meter 110 and subsequently stores the time or volume use information as well as the user information 112.

Figure 1B:
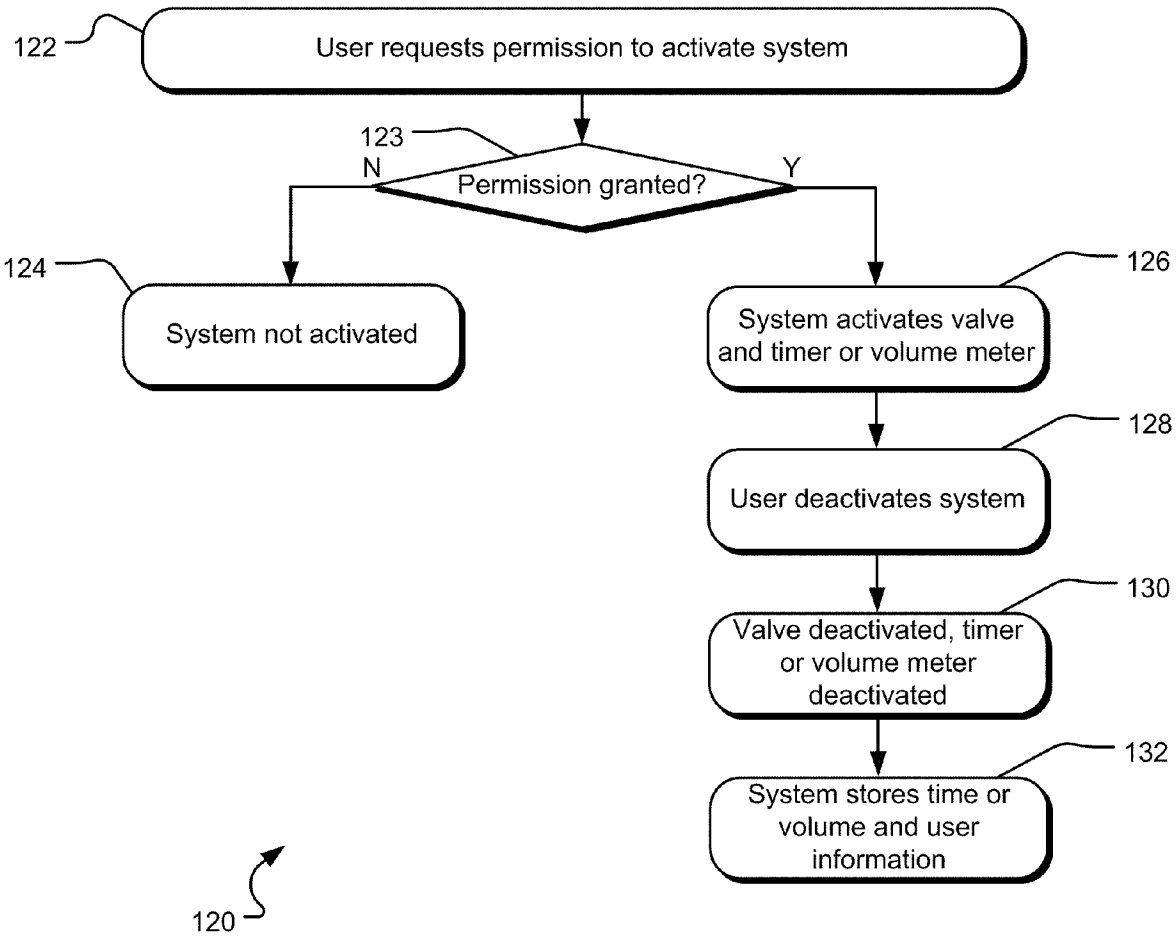

FIG. 1B is a flow diagram tracking an alternative method of use for the water dispensing system of the present invention. Method 120 comprises a first step where a user requests permission to activate the water dispensing system 122 by, e.g., presenting credentials to an electronic access control device which in turn can activate the water supply. At decision point 123, the water dispensing system grants or denies access of the system to the user based on the credentials. If permission to activate the water dispensing system is not granted, the system is not activated 124 and the user does not gain access to the water supply. If, however, permission is granted, the water dispensing system activates both the electronic water flow control apparatus (valve) of the water delivery device (the shower or sink faucet) and a timer or volume meter 126. Once activated, the water dispensing system remains activated until the user deactivates the system 128 by, e.g., again presenting credentials to the electronic access control device. At this point, the electronic access control device either directly or indirectly via the central control unit deactivates both the electronic water flow control apparatus and the timer or volume meter 130. The water dispensing system then stores the time or volume and user information via the electronic access control device or via the central control unit 132. In some aspects of this embodiment, the water dispensing system may also comprise an automatic timer that automatically deactivates the system after a set period of time or volume, e.g., in case a user fails to present his or her credentials to deactivate the system. In this aspect where stored value is used and associated with a user, the user would be charged for the pre-set time or volume rather than the time or volume of actual use.

Figure 1C:
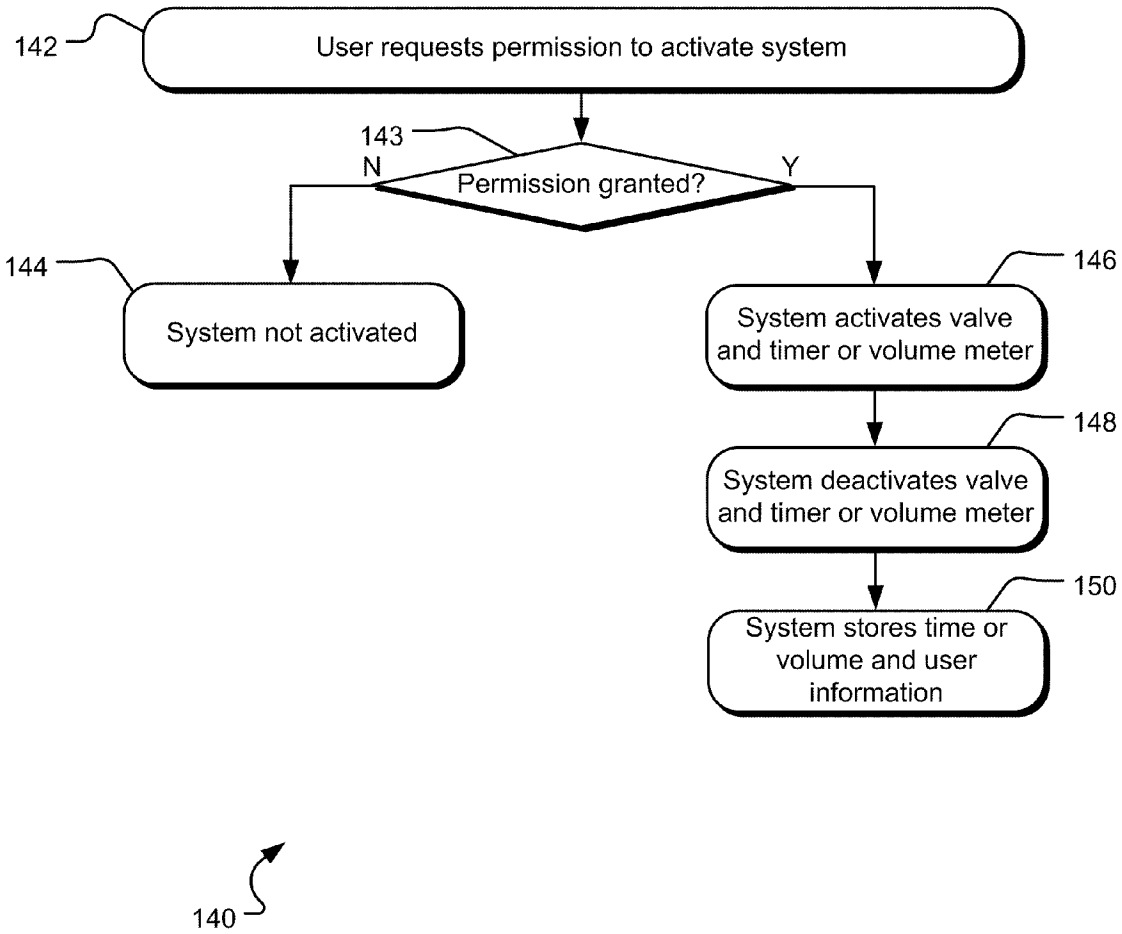

FIG. 1C is a flow diagram tracking yet another method of use for the water dispensing system of the present invention. Method 140 comprises a first step where a user requests permission to activate the water dispensing system 142 by, e.g., presenting credentials to an electronic access control device which in turn can activate the water supply. At decision point 143, the water dispensing system grants or denies access of the system to the user based on the credentials. If permission to activate the water dispensing system is not granted, the system is not activated 144 and the user does not gain access to the water supply. If, however, permission is granted, the water dispensing system activates both the electronic water flow control apparatus (valve) of the water delivery device (e.g., the shower or sink faucet) and a timer and/or volume meter 146. Once activated, the system remains activated until the system self-deactivates 148 after a pre-determined time period or water volume has been reached. The system then stores the time or volume and user information via the electronic access control device or via a central control unit 150.

Figure 1D:
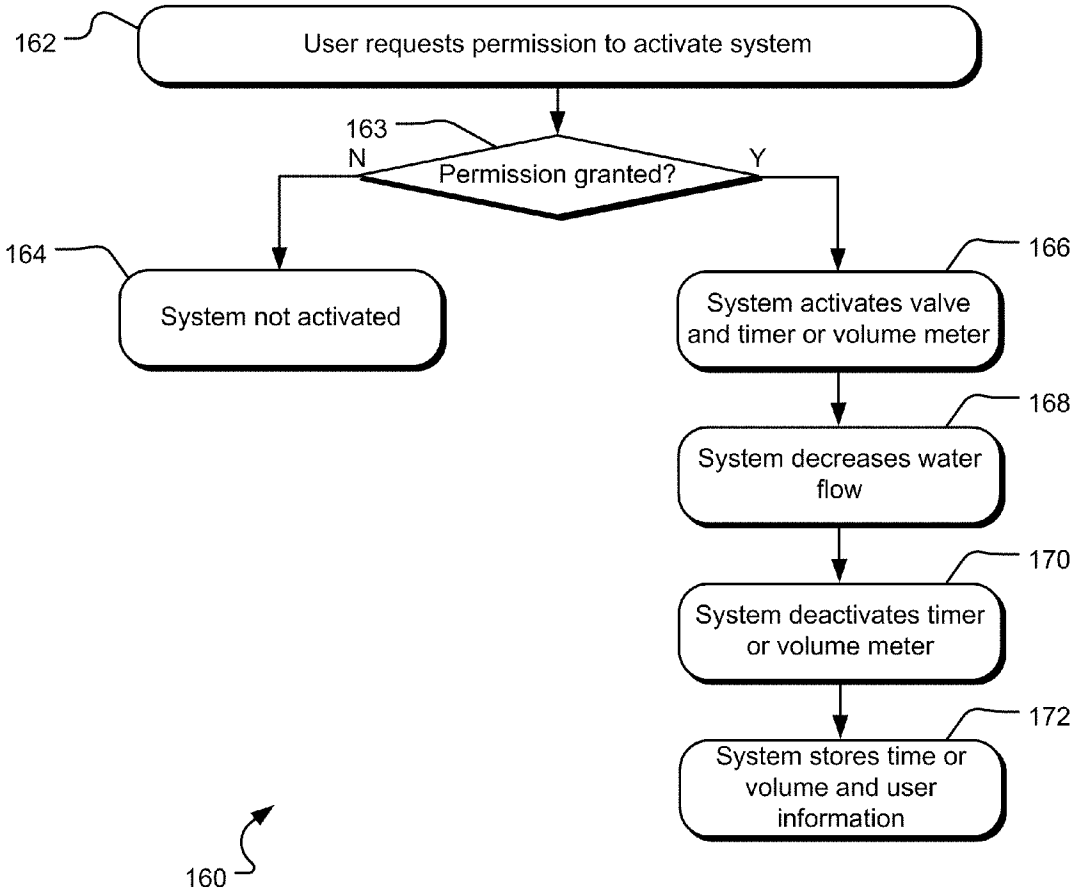

FIG. 1D is a flow diagram tracking yet another exemplary method of use for the water dispensing system of the present invention. Method 160 comprises a first step where a user requests permission to activate the water dispensing system 162 by, e.g., presenting credentials to an electronic access control device which in turn can activate the water supply. At decision point 163, the system grants or denies access to the water dispensing system to the user based on the credentials. If permission to activate the water dispensing system is not granted, the system is not activated 164 and the user does not gain access to the water supply. If, however, permission is granted, the water dispensing system activates both the valve of the water delivery device (the shower or sink faucet) and a timer or volume meter 166. Once activated, the water dispensing system remains activated; however, after a pre-determined time elapses or a pre-determined volume is reached, the system will decrease water flow to the water delivery device 168. After another pre-determined amount of time or volume usage, the system self-deactivates 170, stopping the water flow and the timer and/or volume meter. The system then stores the time or volume and user information via the electronic access control device or via a central control unit 172.

Figure 2A:
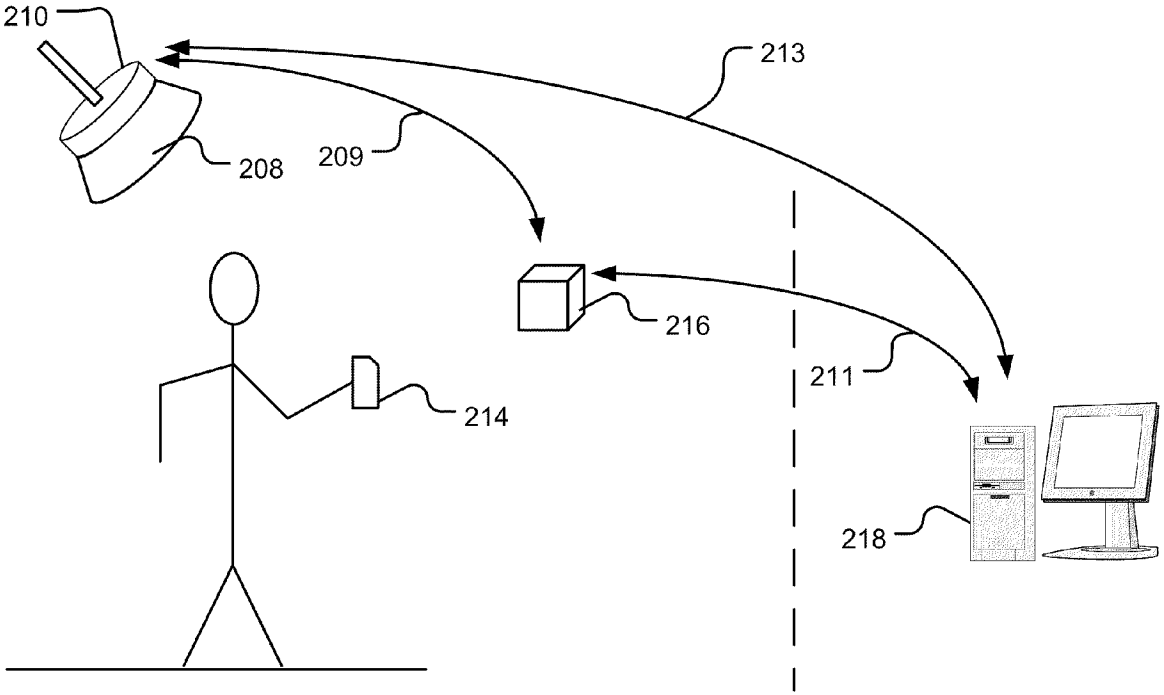
FIG. 2A is an illustration of a shower system using electronic access control according to a preferred embodiment of the present invention.

FIG. 2A is an illustration of a shower system according to a preferred embodiment of the present invention, showing a user 212 with an access card 214 (credentials). The electronically-controlled water dispensing system in FIG. 2A shows only one water delivery device (208) (here, a shower), where a water dispensing system according to the present invention comprises at least two water delivery devices. In addition to the shower 208 and electronic access control device 216, the water dispensing system illustrated comprises a housing 210 for an electronically-controlled valve (the valve is not shown), and a central control unit 218, illustrated here as a personal computer. As illustrated in FIG. 2A, the electronic access control device 216 may interact directly 209 with the valve (not shown) in shower housing 210, or the electronic access control device 216 may interact indirectly with the valve by first contacting 211 the central control unit 218, where the central control unit 218 then contacts 213 the valve.

The water delivery devices of the present invention comprise devices used primarily for personal hygiene, such as sink faucets, toilets, bidets and the like, most preferably showers. The means of electronic control associated with these devices in a preferred embodiment is an electronically-controlled valve, such as a solenoid valve. Solenoid valves are well known in the art. Solenoid valves are controlled by an electric current through a solenoid coil, offering fast and safe switching, high reliability, long service life, good materials compatibility, low control power and compact design. A solenoid valve has two main parts: the solenoid and the valve. The solenoid converts electrical energy into mechanical energy which, in turn, opens or closes the valve mechanically. Solenoid technology related to control of showers is disclosed in U.S. Pat. No. 4,921,209 to Moineau; U.S. Pat. No. 5,402,812 to Moineau, et al.; U.S. Pat. No. 6,016,836 to Brunkhardt; U.S. Pat. No. 6,129,103 to Fields, et al.; U.S. Pat. No. 6,899,133 to Brunkhardt; and US Pat. Pub No. 2005/0016603, all of which are incorporated by reference herein.

Electronic access control devices typically are electronic access card or "smart card" readers or keypads located proximate to the device being accessed, such as a locked door or gate or, in this case, a water delivery device such as a shower. To be granted permission for use, a user must present credentials to an access reader, which in turn verifies the information given. For a keypad, the credentials most typically comprise a code to be entered into the keypad. For smart card devices—which are the preferred devices for the present invention—the credential is the smart card or electronic access card. Smart card systems are well known in the art, and are disclosed in, e.g., *Smart Cards, The New Bank Cards*, Jerome Svigals, MacMillan Publishing (1985); *Smart Card Security and Applications*, Mike Hendry, Artech House (1997); *Security, ID Systems and Locks*, Joel Konicek and Karen Little, Butterworth-Heinemann (1997); *Smart Cards*, Jose Luis Zoreda and Jose Manuel Oton, Artech House (1994); and U.S. Pat. No. 7,376,839, all of which are incorporated by reference herein.

Electronic access cards typically consist of an integrated circuit chip or chips packaged in a convenient form to be carried on one's person. The package may be a card, similar to an ATM card, or may be, e.g., a soldier's dogtag. It may be almost any shape, size and thickness that is convenient for the user to carry, insert into, connect to or present to an electronic access control reader. Electronic access devices typically comprise a card, a reader, and a work station, which may include its own keyboard, display, power and communications interface (such as the central control unit illustrated in FIG. 2A at 218). The electronic access card may comprise several functional abilities, possibly including logic; that is, the logic process may be executed internally in the electronic access card. Alternatively, the logic may be provided to the electronic access card externally. The chips included on the electronic access card may include a complete microprocessor, but most typically are specialized processing chips. Electronic access cards may have temporary or permanent data storage functional ability. The storage content in preferred embodiments may be read externally off the electronic access card, via, preferably, radio frequency or barcode technology, or the storage content may be used internally for information processing and decision making. The chip may also have destroyable, irreversible, alterable entry or storage circuits.

In addition, a typical electronic access control system will comprise a central control unit where the decisions of granting or denying access happen in real time by controlling the electronically-controlled water flow apparatus coupled to the shower, faucet and/or toilet. Each central control unit controls a specific number of electronically-controlled water flow apparatus. Also, the electronic control system of the present invention typically will comprise an electronic access card reader, which reads the information provided on the electronic access card and optionally may perform some of the operations described above as being performed by the central control unit such as granting or denying access or controlling the electronically-controlled water flow apparatus. In addition, the electronic access control system of the present invention comprises communications devices, such as port expanders, modems, repeaters, bridges, gateways and/or routers used to connect the various components of the system to allow exchange of data.

It should be understood by one skilled in the art, however, that the electronic access control system described herein is merely exemplary. For example, the "intelligence" of the electronic access control system may be distributed amongst the electronic access card, the electronic access card reader and the central control unit. Alternatively, the "intelligence" of the electronic access control system may be concentrated in the central control unit, with the electronic access card and the electronic access card reader playing very limited roles; that is, the electronic access card may contain only credentials such as a bar code that can be read by the electronic access card reader, and the electronic access card reader's role may be only to read credentials and transmit the data to the central control unit.

The verification process typically requires an initial communication between, e.g., the electronic access card (credentials) and the electronic access reader or, e.g., keying a code (credentials) into a keypad; and a subsequent communication between the electronic access reader or keypad and the central control unit, with verification of the credentials preferably at the central control unit. If the credentials are verified, the central control unit will communicate with the electronic water flow control apparatus such as a solenoid valve in the water delivery device to have it open and begin delivering water. If the credentials are not verified, the central control unit will not communicate with the solenoid valve and will instead, optionally, communicate with the access reader so that the access reader can communicate to the user that access has been denied. If the credentials are verified, at or about the time the central control unit communicates with the solenoid valve the central control unit will begin to time the duration of the water flow and/or measure the volume of water that is delivered.

In some method embodiments such as those shown in FIGS. 1A and 1B, the central control unit will simply measure the time that the solenoid valve is open and/or measure the volume of water that passes through the valve and store this information. In other method embodiments such as those shown in FIGS. 1C and 1D, the central control unit will measure the time that the solenoid valve is open and/or measure the volume of water that passes through the valve and, after a pre-determined amount of time has elapsed and/or a pre-determined volume of water has passed through the valve, either communicate with the solenoid valve to close completely to stop the flow of water (FIG. 1C), or to close partially to restrict the flow of water (FIG. 1D) with complete stoppage of the water flow at a pre-determined time or water volume thereafter. In yet another embodiment, the water delivery device may further comprise a motion detector such that the electronic water control apparatus is not activated until motion is detected, e.g., a person steps under the showerhead or in front of a sink with an electronically-controlled spigot, and is deactivated when motion is no longer detected. In such an embodiment, the water dispensing system will still grant or deny permission for use based on presentation of credentials; however, activation and/or deactivation of the electronic water control apparatus is based on motion detection.

Once the flow of water to the water delivery device has stopped, the central control unit will record the time elapsed and/or volume delivered, and associate this information with the user's credentials. The information regarding each user's water consumption can be used for many purposes. For example, the information may be used to monitor water usage and/or particularly to charge users for their water consumption. In some embodiments, the credentials may be associated with stored value, similar to a credit card or phone card, where a value of water usage is deducted from the stored value on the credential. Further, the information could be used, for example, to charge more during times of peak energy use or less during off-peak hours. Also, the information may be used to allocate water resources in real time or to determine the individual usage of water of many individuals simultaneously in real time. Obviously in embodiments where the solenoid valve is closed or water flow is decreased at a pre-determined time or volume, the information is used to determine when the solenoid valve should be closed or the water flow should be decreased.

Figure 2B:
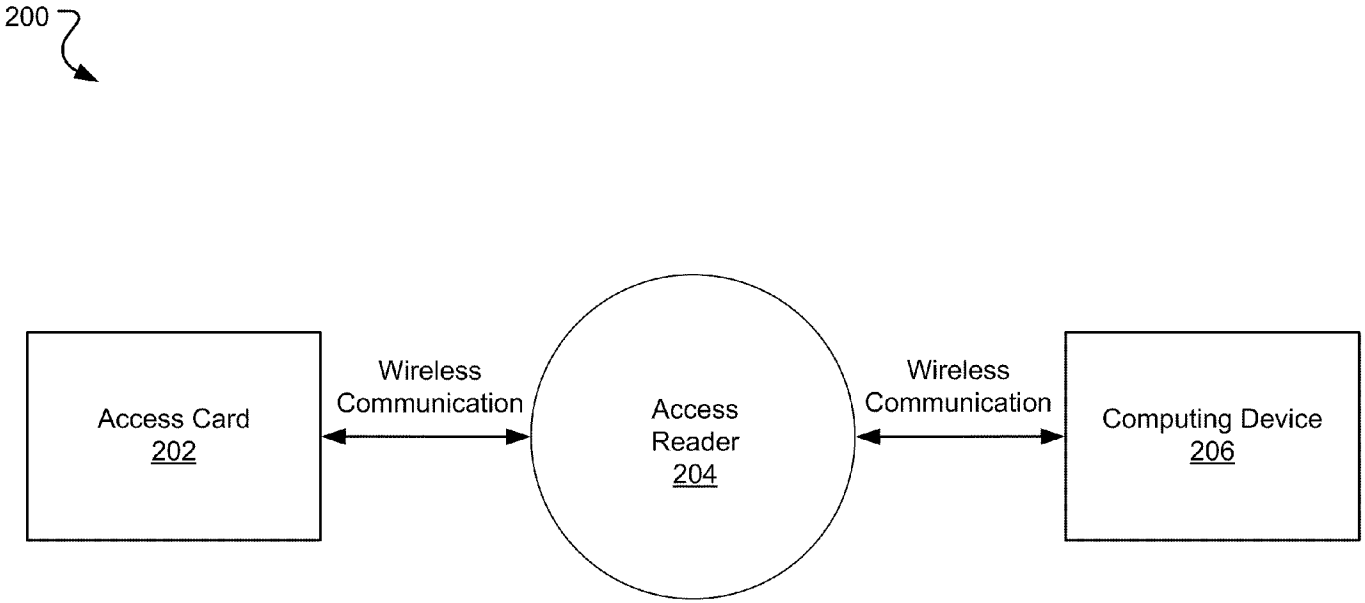
FIG. 2B is a simplified illustration of the initialization components of an electronic access control component of a shower system according to a preferred embodiment of the present invention.

In addition, the water dispensing system of the present invention may be one system in a group of two or more systems controlled or coordinated by a larger building automation system. One well known building automation system is lighting. Often lighting is often controlled by a building automation system where lights are turned on when motion in a room is detected, and turned off within a certain amount of time after motion is no longer detected. In a case where a water dispensing system is one of several or many such systems, the water dispensing system may be independent of the other systems. Alternatively, the water dispensing system of the present invention may be linked to and coordinated with one or more different automated building systems. For example, lighting and heating (if room temperature is below a certain threshold) or cooling (if room temperature is above a certain threshold) may be activated at the time credentials are presented for the water dispensing system, and deactivated when the water dispensing system is deactivated (or, e.g., at a certain period of time after the water dispensing system is deactivated). In such a configuration, the systems would be linked and coordinated. FIG. 2B is a simplified illustration of the initialization components of an electronic access control component 200 of a shower system according to a preferred embodiment of the present invention. In this embodiment, the electronic access control component 200 of the shower system comprises an electronic access card or "smart card" 202, an access reader 204, and a PC device or central control unit 206. The access card 202 communicates 203 wirelessly, for example via radio frequency, with the access reader 204. The access reader 204 comprises a serial port for data communication 205 between the access reader 204 and the central control unit 206. The access reader 204 may be in hardwire communication 205 with the central control unit 206, or the access reader 204 may communicate 205 with the central control unit 206 via wireless communication. Optionally, the electronic access card reader 204 can communicate 203 with and/or write to the electronic access card 202.

Figure 2C:
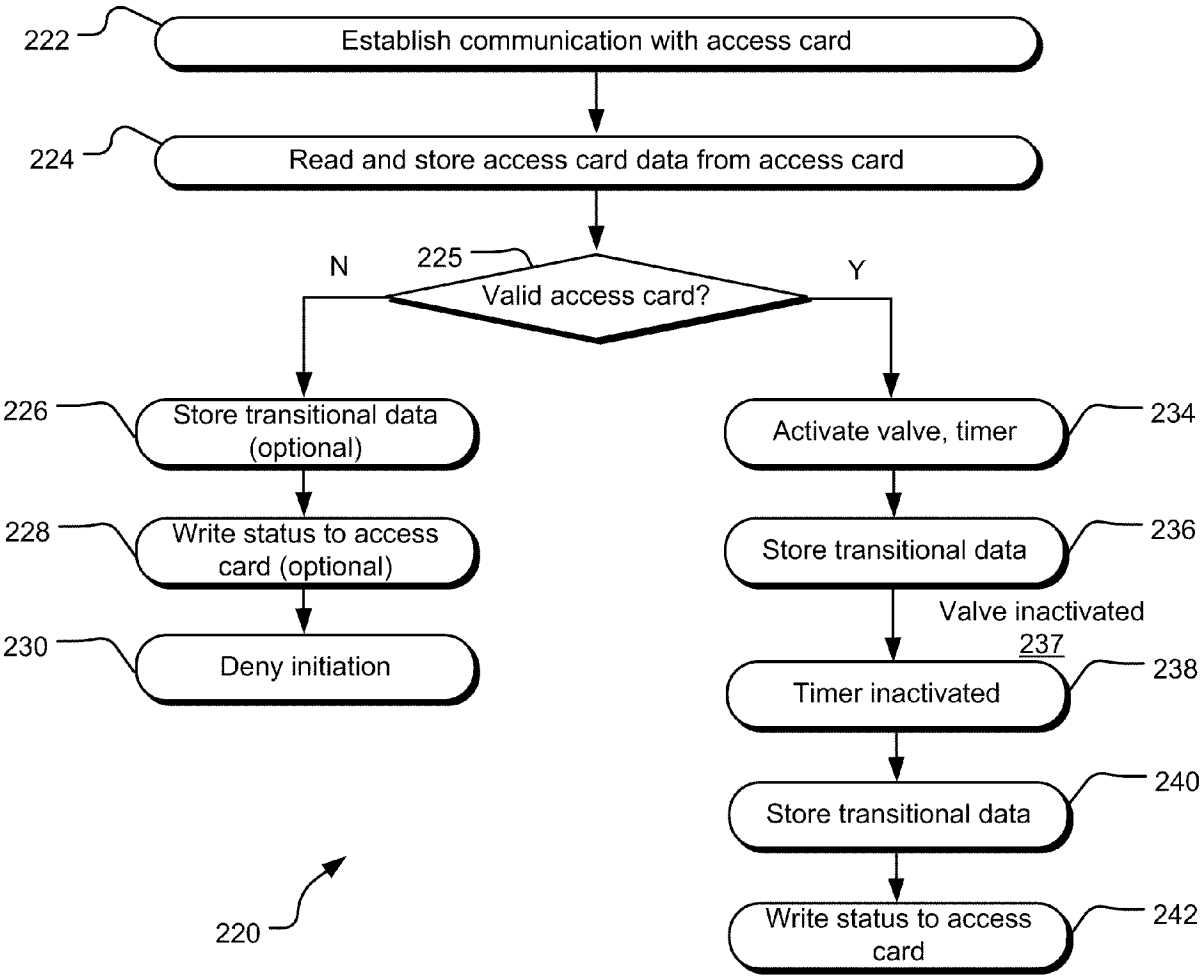
FIG. 2C is a flow diagram for a method of a preferred embodiment for a shower system incorporating electronic access control.

FIG. 2C is a flow diagram of a method 220 of a preferred embodiment for a water dispensing system incorporating electronic access control. In a first step, a user establishes communication with the water dispensing system using an access card 222. The electronic access control card reader reads and, optionally, communicates information from the electronic access card 224 to the central control unit, which then verifies the validity of the electronic access card 225. Alternatively, the electronic access card reader may verify credentials without communicating with the central control unit. If the electronic access card is not valid, the water dispensing system optionally will store transitional information 226, for example, information regarding time of the inquiry and the information contained on the access card, such as user or credential information. In another optional step, the system may write information to the access card 228, and will ultimately deny initiation of the water dispensing system 230. On the other hand, if the electronic access card is valid, the water dispensing system will activate the electronically-controlled water flow apparatus (valve) and activate the time (or volume) meter 234, and store such information (including user/credential information, time and/or volume of water usage, and the like) as transitional data 236. Once the electronically-controlled water flow apparatus (valve) is inactivated 237 either by the user or by the water dispensing system after a pre-determined period of time, the timer and/or volume meter will be inactivated 238 and the timer/volume information will be stored 240 in the water dispensing system by the central control unit, and the timer/volume information will be associated with a credential/user. In another optional step, if the access card is used to close the valve, the timer/volume information may be written to the electronic access card 242.

Figure 3B:
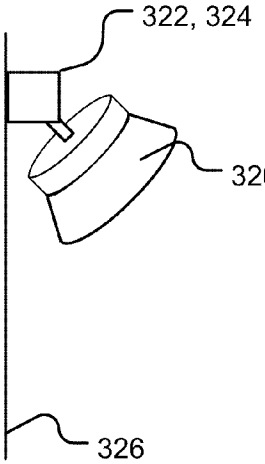
FIGS. 3A through 3D illustrate various shower and electronic access configurations according to the present invention.
Figure 3D:
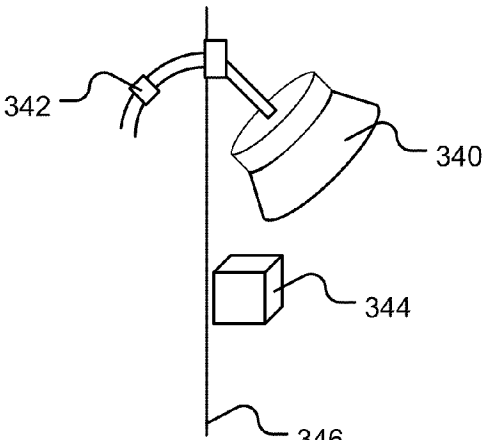
Figure 3A:
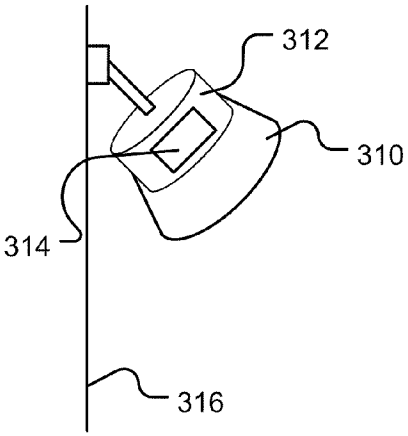
Figure 3C:
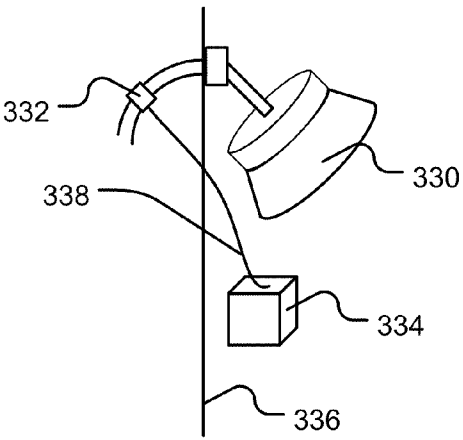

FIGS. 3A through 3D illustrate various water delivery device and electronic access card reader configurations according to the present invention. FIG. 3A shows a showerhead 310, coupled to a solenoid valve housing 312 (the valve is not shown), where the solenoid valve housing 312 comprises an electronic access card reader 314. The shower wall is at 316. FIG. 3B shows an alternative embodiment of the water delivery device and electronic access components of the present invention with the showerhead 320, coupled to a solenoid valve housing 322 (the valve is not shown), where the solenoid valve housing 322 comprises an electronic access card reader 324. The shower wall is at 326. FIG. 3C shows yet a third embodiment of the water delivery device and electronic access components of the present invention. In this embodiment, showerhead 340 is not immediately proximate to the electronic access card reader 334. Instead, the electronic access card reader 334 is mounted on the wall 336 near the shower. The electronic access card reader 334 is electrically linked 338 to solenoid valve 332 contained in the plumbing coupled to showerhead 330 inside wall 336. Finally, FIG. 3D shows yet another water delivery device and electronic access card reader configuration, where, as in FIG. 3C, the solenoid valve 342 is contained in the plumbing coupled to the showerhead behind the shower wall 346. However, in this configuration, the electronic access card reader 344 communicates wirelessly with solenoid valve 342.

The preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims. In the claims that follow, unless the term "means" is used, none of the features or elements recited therein should be construed as means-plus-function limitations pursuant to 35 U.S.C. §112, ¶6.

We claim:

1. A water dispensing system for personal hygiene comprising:

one or more electronic access control devices; two or more electronically-controlled water delivery devices each comprising an electronic access card reader; a stored value access card; at least one central control unit executing computer code to control valves in response to verification of credentials; and said computer code, wherein said computer code verifies credentials, communicates a result of verification of credentials to the valves; measures time or volume of said water flow, records said measured time or volume of said water flow for each credential, and adds and subtracts stored value associated with a credential.

2. The water dispensing system of claim 1, wherein said central control unit communicates wirelessly with said two or more electronically-controlled water delivery devices.

3. The water dispensing system of claim 1, wherein said electronic access control device comprises a key pad.

4. The water dispensing system of claim 1, wherein each of said two or more electronically-controlled water delivery devices comprises a solenoid valve.

5. A water dispensing system for personal hygiene comprising:

one or more stored value access cards comprising credentials; two or more electronically-controlled water delivery devices each comprising an electronic access card reader that communicates with at least one central control unit; at least one central control unit that communicates wirelessly with said one or more access card reader; and computer code executed by the at least one central control unit, wherein said computer code verifies said credentials received from the electronic access card readers, activates water flow to the two or more water delivery devices, measures time or volume of said water flow, records said measured time or volume of said water flow for said credentials, and adds and subtracts stored value associated with said credentials.

6. A method of controlling a water dispensing system for personal hygiene comprising: presenting credentials to an electronic access control device comprising a stored value access card and an electronic access card reader; communicating information about said credentials from said electronic access card reader to a central control unit; and executing computer code on the central control unit that: determines whether permission to use said water dispensing system should be granted to said credentials; activates a valve controlled by the central control unit coupled to said water dispensing system if permission is granted and does not activate a valve controlled by the central control unit coupled to said water dispensing system if permission is not granted; activates a time or volume meter associated with said activated valve; deactivates said time or volume meter when said valve is deactivated; records said time or volume; associates said recorded time or volume with said credential; and debits an amount of money for the water used from said stored value access card.

7. The method of claim 6, wherein said electronic access control device comprises a key pad.

8. The method of claim 6, wherein said valve is a solenoid valve.

9. The method of claim 6, wherein said deactivation is accomplished automatically by said water dispensing system after a pre-determined time or volume of water has been dispensed.

10. The method of claim 6, wherein said deactivation is accomplished by a user presenting credentials to said electronic access control device.

* * * * *